United States Patent [19]

Furia

[11] Patent Number: 4,989,425

[45] Date of Patent: Feb. 5, 1991

[54] APPARATUS FOR THE ELECTRONICALLY CONTROLLED THREE-POSITION ELECTROMAGNETIC SELECTION OF NEEDLES FOR CIRCULAR KNITTING MACHINE WITH ALTERNATE MOTION

[76] Inventor: Edoardo Furia, Via Volterrana, 86, 50020 La Romola S. Cadciano V. Pesa (Firenze), Italy

[21] Appl. No.: 351,023

[22] Filed: May 12, 1989

[30] Foreign Application Priority Data

Apr. 26, 1989 [IT] Italy ..... N9411 A/88

[51] Int. Cl.[5] ..... D04B 15/78

[52] U.S. Cl. ..... 66/220; 66/75.2; 66/221; 66/222

[58] Field of Search ..... 66/220–223, 66/228, 230, 97.8

[56] References Cited

U.S. PATENT DOCUMENTS

| | | | |
|---|---|---|---|
| 3,534,566 | 10/1970 | Farmer et al. | 66/221 |
| 3,971,233 | 7/1976 | Amaya et al. | 66/222 |
| 3,987,646 | 10/1976 | Knourek et al. | 66/220 |
| 4,023,383 | 5/1977 | Klinger | 66/220 |
| 4,686,839 | 8/1987 | Schmid | 66/75.2 |
| 4,738,123 | 4/1988 | Tibbals, Jr. | 66/220 |
| 4,739,636 | 4/1988 | Manini | 66/220 |
| 4,793,159 | 12/1988 | Sawazaki | 66/220 |

OTHER PUBLICATIONS

Disc Selection Systems, Borowy and Knapton Knitting Times, Feb. 1976, vol. 45, No. 6, pp. 41–53.

*Primary Examiner*—Werner H. Schroeder
*Assistant Examiner*—John J. Calvert
*Attorney, Agent, or Firm*—McGlew and Tuttle

[57] ABSTRACT

In order to carry out the three-position selection of needles, that is, for floated stitch, retained stitch and discharged stitch, in either direction of rotation of the needles cylinder of a circular knitting machine with alternate motion for the production of socks with inlay patterns a cylinder is provided with needles and underneedles, and with pusher jacks provided with a heel (7,8) at both ends and engaged to a rear, centrifugal action spring. Two oscillating selectors vertically superimposed and symmetrically disposed with respect to the horizontal separation line are provided. Two electromagnets are provided vertically superimposed for the selection of said oscillating selectors. Such selection apparatus it is possible to reduce the diameter of the needles cylinder to less than 4" with a fineness above 120 needles and to work at a speed higher than the one presently allowed.

5 Claims, 5 Drawing Sheets

Fig. 6
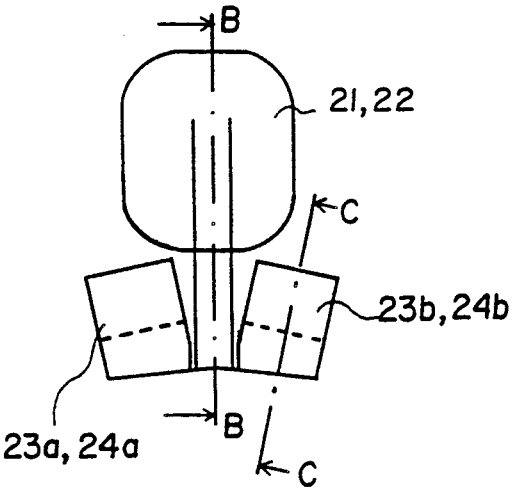
Fig. 7
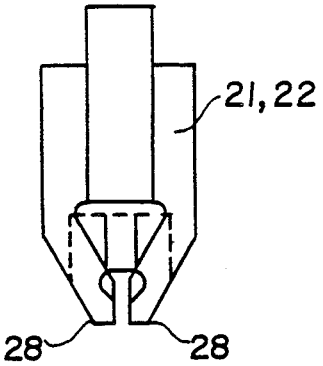
Fig. 8
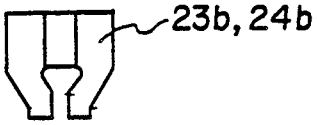
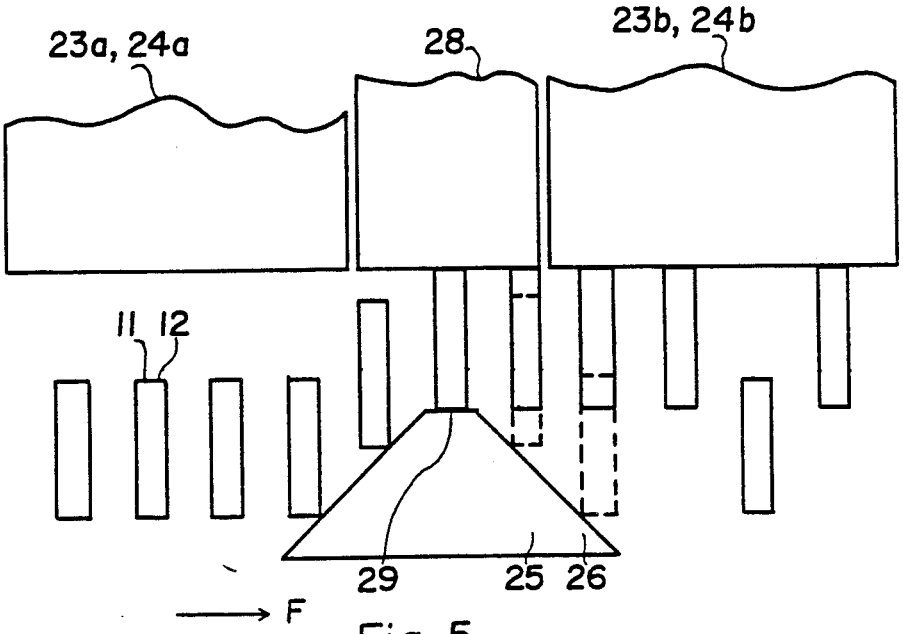
Fig. 5

APPARATUS FOR THE ELECTRONICALLY CONTROLLED THREE-POSITION ELECTROMAGNETIC SELECTION OF NEEDLES FOR CIRCULAR KNITTING MACHINE WITH ALTERNATE MOTION

FIELD AND BACKGROUND OF THE INVENTION

The present invention relates generally to an apparatus for the electronically controlled, electromagnetic three-position selection of needles for a circular knitting machine with alternate motion, and in particular to circular knitting machine for the manufacturing of socks with inlay patterns.

It is known that in circular knitting machines, selection groups are utilized which are disposed around the needle cylinder, before each feeder or fall. Each selection group is made up of an electromagnet interposed between two permanent magnets, and of a pressure cam located in correspondence with the magnet disposed upstream of the electromagnet in the feeding direction of the cylinder, in order to push, against the latter, the oscillating selector associated with a spring pusher jack.

The electromagnet is driven—according to an electronic program synchronized with the motion of the needles cylinder—through a modulated passage. An interruption or a reversal of the current direction is provided for selectively keeping the oscillating selector attracted and adherent to the magnets, preventing the heel of three elastic jack from engaging a driving cam and for causing the disengagement of the corresponding needle. This arrangement is also provided for releasing (driving back) the oscillating selector thereby causing the lifting of the heel of the elastic jack by the same driving cam and the engagement of the corresponding needle.

Accordingly, for each feeder, as many selection groups are needed as the driving cam. Where it is desirable to have three-position section of the needles (that is, for floated stitch, retained stitch and discharged stitch) two selection groups are needed for each feeder and, in case of a circular machine with alternate motion, four selection groups are needed as disclosed in U.S. Pat. No. 3,972,206 and in the Italian application Ser. No. 9472-A/84.

By using the so-called "memory" systems, of the electromagnetical type for example, it is possible to reach a solution with three selection groups in which the central group cooperates alternatively with either of the side groups, but, as far as the machines for small-diameter socks are concerned, some dimensional, reliability and mechanical problems arise which make this solution unacceptable. By using an electromagnetic selection, one encounters the problem of the pressure cams, which are provided for pressing the oscillating selector against the magnet, being upstream of the selection electromagnet on every selection and in both directions of rotation. These cams, when of a fixed type, are incompatible with the needle path or otherwise, require complicated synchro devices.

Moreover, the electromagnet must exhibit a maximum width equal to the distance between one needle and the next in order to act one at a time on the single selector without interfering with adjacent ones.

The major problems concerning the known electromagnetic systems are therefore related to the available space and to the attraction force provided by the selection electromagnets. In fact, the space required to select three positions of the needles in both directions of the needles cylinder motion in a four-feeder machine for manufacturing socks with inlay patterns, for example, is such as to not allow the utilization of cylinders of a diameter smaller than four inches, while making it necessary to provide a cylinder diameter of $3\frac{3}{4}''$ or even of $3\frac{1}{2}''$ when a fineness exceeding 120 needles is required. Besides, the attraction or repulsion force of the selection electromagnet, being dependent on the cross-section of the magnetic flux passageway, is directly dependent on the needles pitch as mentioned above. Accordingly, in case of great fitness, the attraction or repulsion force is much reduced and, once the saturation level has been reached, it cannot be increased any longer even if the number of the coils or the current intensity is increased. The weakness of the magnetic force makes the balance among the elastic reaction of the selector, the inertia of the moving parts, centrifugal force, friction, etc., very uncertain thereby disadvantageously limiting the maximum available speed and the operation safety. To reduce the wear of the magnets, the surface which the magnet-attracted selector members are to slide on has been made of non-magnetic material, but this exerts a tangential force which pushes the selector members against the slot walls thereby increasing the friction forces and hindering the free movement of the same members proportionally to the operation speed. Finally, in order to obtain the elastic reaction of the selector being loaded at one end, a joint pressure is to be maintained at the other end which gives rise to an undesirably high sliding force when considering the length of the selector.

SUMMARY AND OBJECTS OF THE INVENTION

The object of the present invention is to overcome the above-mentioned drawbacks.

According to the invention for each needle a two-heel pusher jack is utilized. One heel is provided per each jack end. The jack ends are separately urged outwardly of the cylinder by at least one spring. Two respective oscillating selectors are provided, vertically superimposed at a position facing the pusher jack. For each feeder, two electromagnets are provided, vertically superimposed for the separate selection of said oscillating selectors. Each electromagnet is interposed between two permanent retaining magnets and cooperating with the correspondent oscillating selector pushed thereagainst by a pressure cam of symmetric shape, in order to select or skip the corresponding heel of the pusher jack. Two cams are provided, a lower cam and an upper cam, to lift the relevant selected pusher jacks to the position of retained stitch and of discharged stitch, respectively.

According to further characteristics of the invention, each oscillating selector oscillates about a central axis to allow one of its ends to cooperate with the pusher jack and with the corresponding pressure cam, and to allow the other end to cooperate with a peripheral ring able to keep the electromagnet-attracted oscillating selectors slightly spaced from the magnets and from the electromagnets so as to reduce the wear of the magnets and the drag-resisting forces.

The solution proposed by the present invention allows the making of a circular knitting machine with alternate motion, with a cylinder of reduced dimension, with the selection electromagnets having poles of larger cross-section and thus exhibiting a greater attraction force while utilizing pressure cams with crests shorter than the pegs to push the oscillating selectors directly against the electromagnets. This solution also prevents the pusher jacks from being elastic and thus allows the relevant high, elastic and hardly controllable reaction forces, as well as the cantilever-like joint reactions, to be suppressed. But above all, the invention allows the making of a circular knitting machine having great operation reliability even at very high speed, having moderate cost, and of easy adjustment, check and maintenance especially in the case of manufacturing socks with inlay patterns.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 5 is the section on lane A—A of FIG. 1 to point out the function of the selection electromagnet and a pressure cam;

FIG. 6 is a section along a horizontal plane of an electromagnet with relevant permanent magnets;

FIG. 7 is the section on line B—B of FIG. 6;

FIG. 8 is the section on line C—C of FIG. 6.

DETAILED DESCRIPTION OF THE PREFERRED EMBODIMENT

Figure 1:
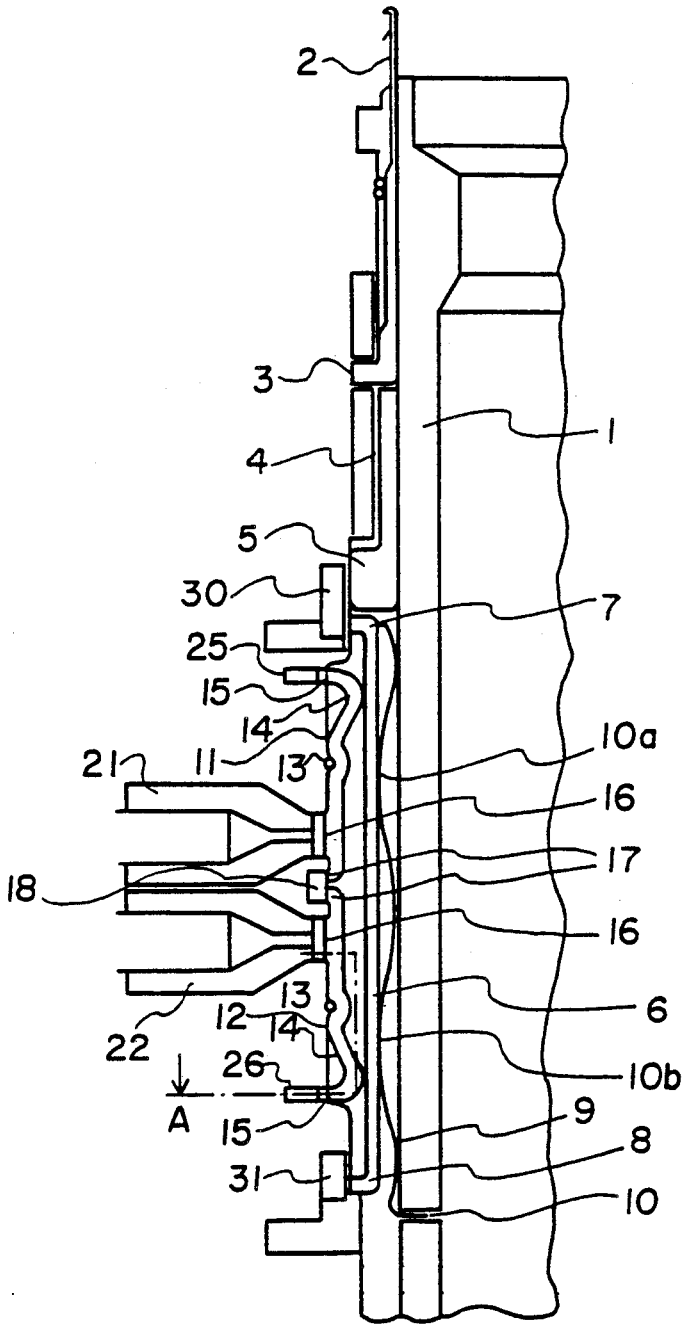
FIG. 1 is a radial section of the needle cylinder with a group of selection electromagnets, according to the invention, in the floated stitch position.
Figure 2:
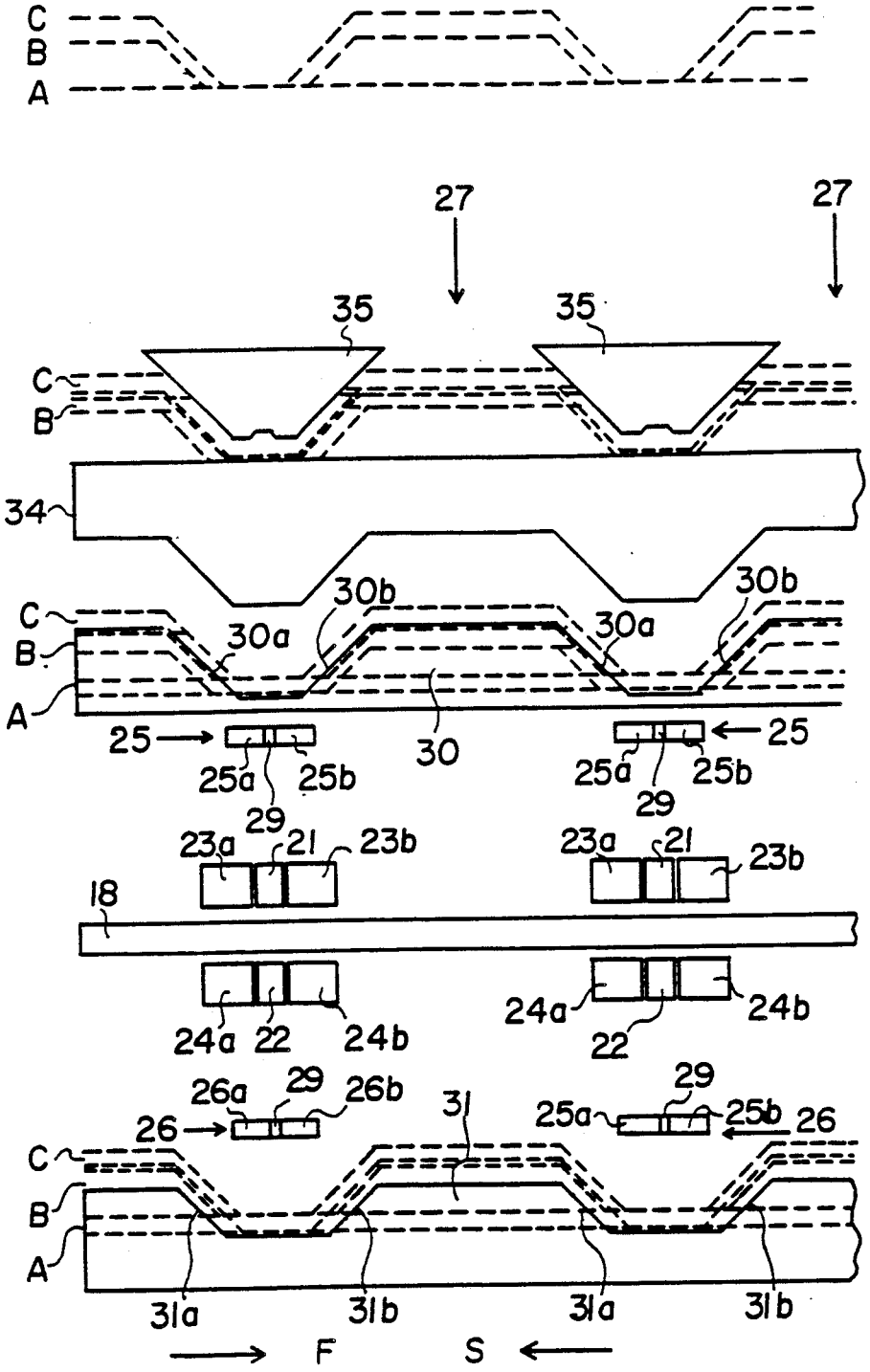
FIG. 2 is a view of the development of the cams mantle with the various selection groups according to the invention.

Reduced to its essential structure and with reference to FIGS. 1 and 2 of the attached drawings, a needle-by-needle selection apparatus in a circular knitting machine with alternate motion according to the present invention, comprises:

- a needle cylinder 1 with needles 2 and underneedles 4;
- a pusher jack 6, associated with each underneedle 4, which is rigid and has pusher jack ends 7, 8 which are heel-shaped, the pusher jack also pushed outwardly of cylinder 1 and which has a wavy profile with two convexities 10*a* and 10*b* for the contact with upper and lower zones of said pusher jack 6 respectively;
- two oscillating selectors 11, 12 of ferromagnetic material, vertically superimposed, of equal shape, but symmetrical with respect to a horizontal separation line, which pivot about their own pivoting point 13 and with the respective back facing against the front of the pusher jack 6 so as to maintain the latter in its seat.

Each of the selectors 11, 12 has a profile with a linear portion and with a convexity 14 for the contact of the pusher jack 6. Each of the selectors 11, 12 includes a first end heel 15 for the contact with a pressure cam 25, 26 and a second median heel 16 making up the attraction anchor of the electromagnetic selection system and with a third heel 17 for the contact with a ring 18. The ring 18 is formed of nonmagnetic material and concordantly rotates with the needles cylinder, whose function is to be pointed out later. A number of electromagnetic selection groups are provided, each positioned between two adjacent feeders 27.

Each selection group comprises two electromagnets 21, 22, an upper one and a lower one, which are made to act on the central heels 16 of the said oscillating upper selector 11 and lower selector 12, respectively. Each of the electromagnets 21, 22 is interposed between two permanent retaining magnets 23*a*, 23*b* and 24*a*,24*b*, respectively.

Two pressure cams 25, 26, an upper one and a lower one, are disposed along the same vertical line which passes through the axis of each group of electromagnets 21, 22, whose symmetrical profiles 25*a*, 25*b* and 26*a*, 26*b* are intended to engage with the heel 15 of the corresponding oscillating upper selector 11 and lower selector 12, respectively.

Such a disposition of the electromagnets 21, 22 and of the pressure cams 25, 26 allows the utilization of electromagnets having poles of significantly increased cross-section with respect to those currently used for the electromagnetic selection. The provision of pressure cams 25,26, with crest 29 having length less than that of the pegs, allows the cams to be positioned directly in correspondence of the selection electromagnets 21,22 without any risk of interference by the next permanent magnets.

A fixed mantle cam is provided comprising: two cams 30,31, and upper cam and a lower cam, intended to act on the upper and lower heel, respectively, of the selected pusher jacks 6. Each of the cams 30,31 is angularly disposed equidistant between two consecutive selection groups and with the symmetrical profiles 30*a*, 31*a* and 30*b*, 31*b*, respectively on the vertical of the relevant permanent magnets 23*a*, 24*a* and 23*b*, 24*b*.

Figure 3:
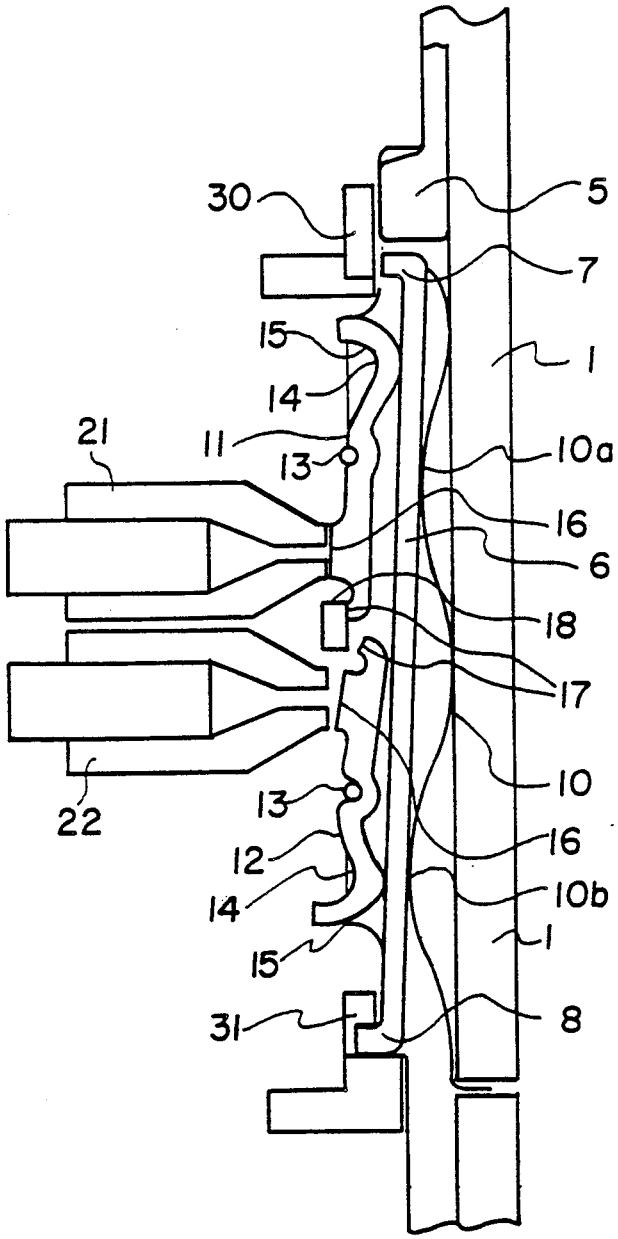
FIG. 3 is a detailed view of the selection group of FIG. 1 in the retained stitch position.

The cam 31 has such a height as to be able to lift the lower heel 8 of jacks 6, selected by the corresponding oscillating selector 12 (in the unattracted state) from the lower, floated stitch position A to the intermediate retained stitch position B (see FIG. 3). Cam 30 has such a height as to lift the upper heel 7 of the jacks 6, selected by the corresponding oscillating selector 11 (in the unattracted state) from the lower, floated stitch position A to the upper, discharged stitch position C (see FIG. 4). The mantle of cams comprises also the traditional cams 34 for the lowering of heels 5 of the underneedles 4 and the cams 35, used during the stitch formation, for the lowering of the heel 3 of needles 2.

The operation is as follows.

With the needles cylinder 1 rotating in the direction of arrow F, the oscillating selectors 11 and 12 are actuated, in correspondence with selection group 21, 22, by the profiles 25*a* and 26*a* of the relevant pressure cams 25 and 26, so that the heels 17 of said selectors come in contact with the ring 18. The convexity 14 urges the pusher jack 6 inwardly by overcoming the elastic resistance of the spring 10. Owing to the presence of ring 18, the heels 16 of selectors 11, 12 are kept slightly spaced from the respective electromagnets 21, 22 even if attracted by the latter, in order to prevent the electromagnets and the magnets from wearing out and to reduce the friction, but maintaining, at the same time, all the magnetic attraction force of the same electromagnets thanks also to the larger cross-section of their poles.

Under such conditions, thee are three selection possibilities:

1*a* selection (for floated stitch).

The two electromagnets 21 and 22 are energized and the oscillating selectors 11, 12 once they have left the pressure cams 25 and 26, remain attracted by the electromagnets. Subsequently, the oscillating selectors 11, 12, remain attracted by the permanent magnets 23*b* and 24*b* which are downstream of the electromagnets in the direction of motion, so that the upper heel 7 and the lower heel 8 of the pusher jack 6 are retracted. In this retracted position, (see FIG. 1) the upper heel and the lower heel pass behind cams 30 and 31 and proceed to the lower position A up to the following selection group, while the needle 2 remains inoperative.

2*a* selection (for retained stitch).

The lower electromagnet 22 is de-energized thereby leaving the heel 16 of the lower oscillating selector 12, so that the lower heel 8 of the pusher jack 6, urged by the spring 10, engages the cam 31 (see FIG. 3).

This occurs with the cooperation of the thrust exerted by the spring 10 and the pressure cam 25 while the permanent magnet 23*b*, which is disposed downstream of the electromagnet, is inoperative. In this position the lower selector 12 is attracted by the permanent magnet 24*b* which is positioned downstream of the electromagnet 22, and the lower heel 8 of the pusher jack 6 is engaged by the profile 31*b* of cam 31 and lifted to the intermediate position B, while the upper heel 7 goes behind cam 30. In the meantime, cam 35 guides the heel 3 of needle 2 for the formation of the retained stitch. Afterwards, the cam 34 operates to bring the underneedle 4 and pusher jack 8 back to the lower position A for the successive selection.

3*a* selection (for discharged stitch).

Figure 4:
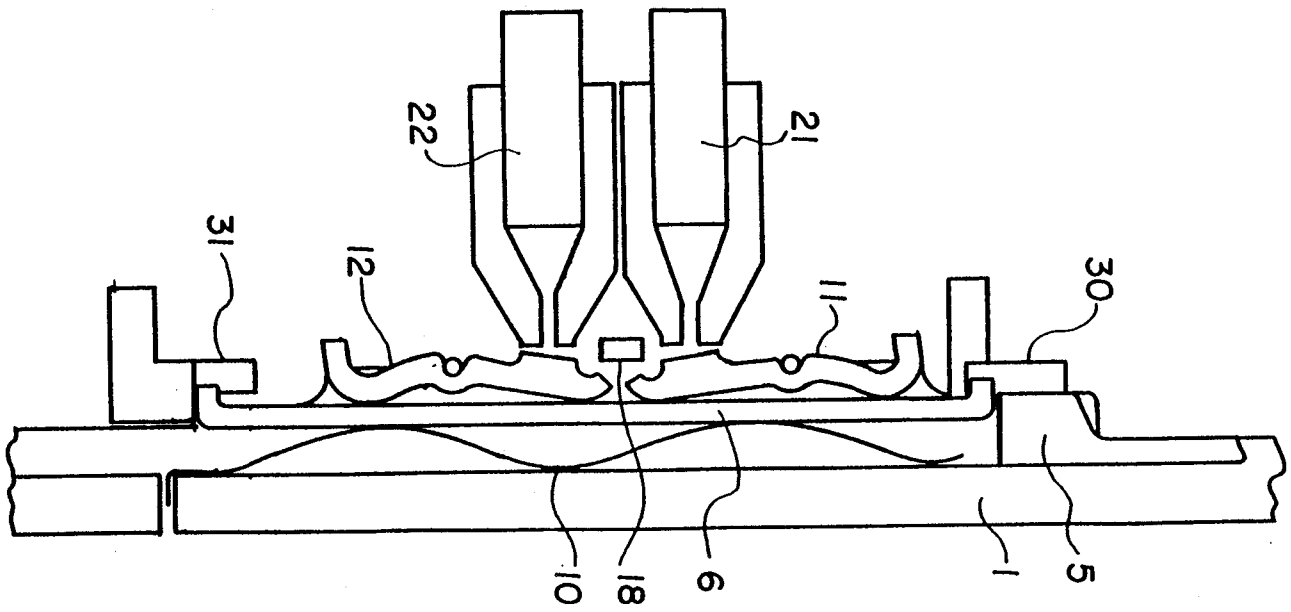
FIG. 4 is the detailed view of the selection group of FIG. 1 in the discharged stitch position.

Neither of the two electromagnets 21 and 22 is energized; the two oscillating selectors 11, 12, guided by the pressure cams 25 and 26 and under the force of spring 10, come back to the selection position (see FIG. 4). In this position the profile 30*b* of cam 30 —which is positioned slightly upstream, in the feeding direction of the cylinder, of profile 31*b* of cam 31-engages the heel 7 of pusher jack 6 and raises it up to the upper position C while the needle 2 casts a discharged stitch by the stitch-formation cam 35.

Thereafter, the underneedle 4 and the pusher jack 6 are lowered again by the cam 34 down to the lower position A for the successive selection.

In the opposite feeding direction of the needles cylinder 1, that is, in the direction of arrow S, the operation and the selection take place exactly in the same way, but the permanent magnets used and the active profiles of cams 30, 31 are those indicated by 23*a*, 24*a* and 30*a*, 31*a* as they result upstream, in the motion direction of electromagnets 21, 22.

Practically, the construction details may vary in equivalent way as far as the shape, dimensions, disposition of the elements and nature of the used materials are concerned without departing from the scope of the present invention.

While a specific embodiment of the invention has been shown and described in detail to illustrate the application of the principles of the invention, it will be understood that the invention may be embodied otherwise without departing from such principles.

I claim:

1. An apparatus for the electronically controlled three-position electromagnetic selection of needles for a circular knitting machine with alternate motion comprising:

a needle cylinder including needles, underneedles connected to said needles and pusher jacks engageable with said underneedles;

oscillating selector means for needle section including oscillating selectors cooperating with pressure cams;

first and second electromagnets, each electromagnet being interposed between two permanent magnets for the selection of the oscillating selectors;

a first cam for driving the pusher jacks to a lower position for a retained stitch;

a second cam for driving the underneedles into the upper position for a discharged stitch;

a third cam for driving the needles upon the formation of a stitch;

said pusher jacks including a straight body with upper and lower ends each formed heel-shaped;

a spring positioned adjacent said pusher jack for urging said pusher jack outwardly from said needle cylinder;

said oscillating selectors are disposed vertically superimposed and symmetrically arranged with respect to a horizontal separation line, each oscillating selector including a convex portion turned toward a portion of the pusher jack and including heels directed outwardly of the needle cylinder, an end heel of each oscillating selector being provided for the contact with a pressure cam and with a spacer ring respectively, and an intermediate heel of each oscillating selectors being provided for magnetic attraction by a corresponding one of said electromagnets and associated permanent magnets;

said electromagnets are disposed superimposed on the same vertical plane, each electromagnet having poles juxtaposed to a corresponding said intermediate heel;

said pressure cams are disposed substantially aligned vertically and substantially lined up with the axis of said electromagnets; and said cam is provided for the displacement of the upper heel of pusher jacks and of the superimposed heel of underneedle.

2. An apparatus according to claim 1, wherein said pusher jacks are formed as rigid members.

3. An apparatus according to claim 1, wherein said spring is provided with a curvilinear profile with two convexities turned towards the corresponding pusher jack, said two convexities being provided symmetrically with respect to three convexities turned towards the needle cylinder to form two symmetrical and diametrically opposite points of the pusher jack.

4. An apparatus according to claim 1, wherein said pressure cams have a crest smaller than the width of the poles (28) of said electromagnets.

5. An apparatus according to claim 1, wherein said spacer ring is disposed in a position to avoid the sliding of the corresponding heel of the two oscillating selectors on the poles of the electromagnets, said spacer rotating concordantly with the needle cylinder.

* * * * *